United States Patent [19]

Zephinie

[11] 3,977,495

[45] Aug. 31, 1976

[54] RESCUE APPARATUS

[75] Inventor: Gerard Zephinie, Paris, France

[73] Assignee: Societe Soberal S.A., Luxemburg

[22] Filed: Apr. 16, 1975

[21] Appl. No.: 568,445

Related U.S. Application Data

[62] Division of Ser. No. 477,071, June 6, 1974.

[30] Foreign Application Priority Data

June 5, 1974 France ..... 73.20410

[52] U.S. Cl. ..... 182/48; 193/25 E; 193/25 S; 193/34

[51] Int. Cl.[2] ..... A62B 1/20

[58] Field of Search ..... 182/48, 49; 193/25 R, 193/25 E, 25 S, 25 C, 32, 34, 33

[56] References Cited

UNITED STATES PATENTS

| | | | |
|---|---|---|---|
| 482,274 | 9/1892 | Pride | 182/49 |
| 1,005,032 | 10/1911 | Hennessee | 182/49 |
| 1,015,937 | 1/1912 | Brevetti | 182/49 |
| 3,348,630 | 10/1967 | Yamamoto | 182/48 |
| 3,580,358 | 5/1971 | Yamamoto | 182/48 |

FOREIGN PATENTS OR APPLICATIONS

| | | | |
|---|---|---|---|
| 113 | 1863 | United Kingdom | 182/49 |

*Primary Examiner*—Reinaldo P. Machado
*Attorney, Agent, or Firm*—Stevens, Davis, Miller & Mosher

[57] ABSTRACT

This invention relates to a rescue apparatus for enabling persons to escape safely from burning buildings, for instance, comprises a flexible tubular device which is elastic only in the transverse and circumferential direction to slow that rate of descent of a body falling through the tubular device, various means being provided for fixing the open upper end of the tubular device to the elevated point whence the body or persons is to be rescued through the lower open end of the device at a point therebelow.

3 Claims, 11 Drawing Figures

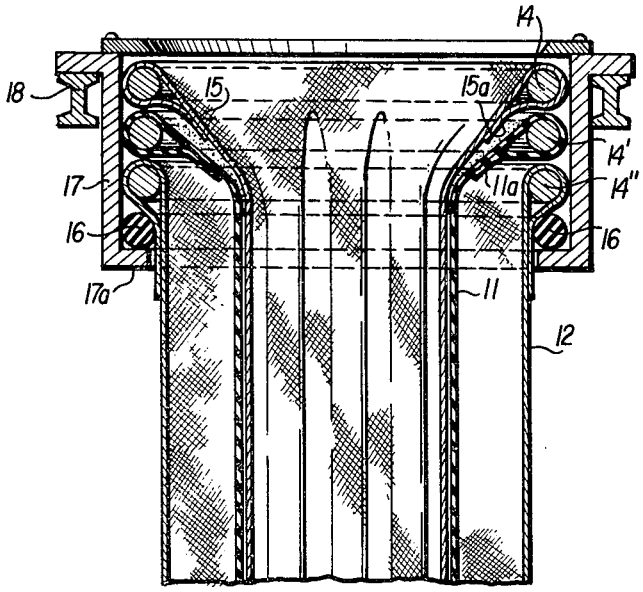
FIG. 1
FIG. 2
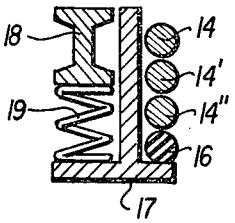
FIG. 3
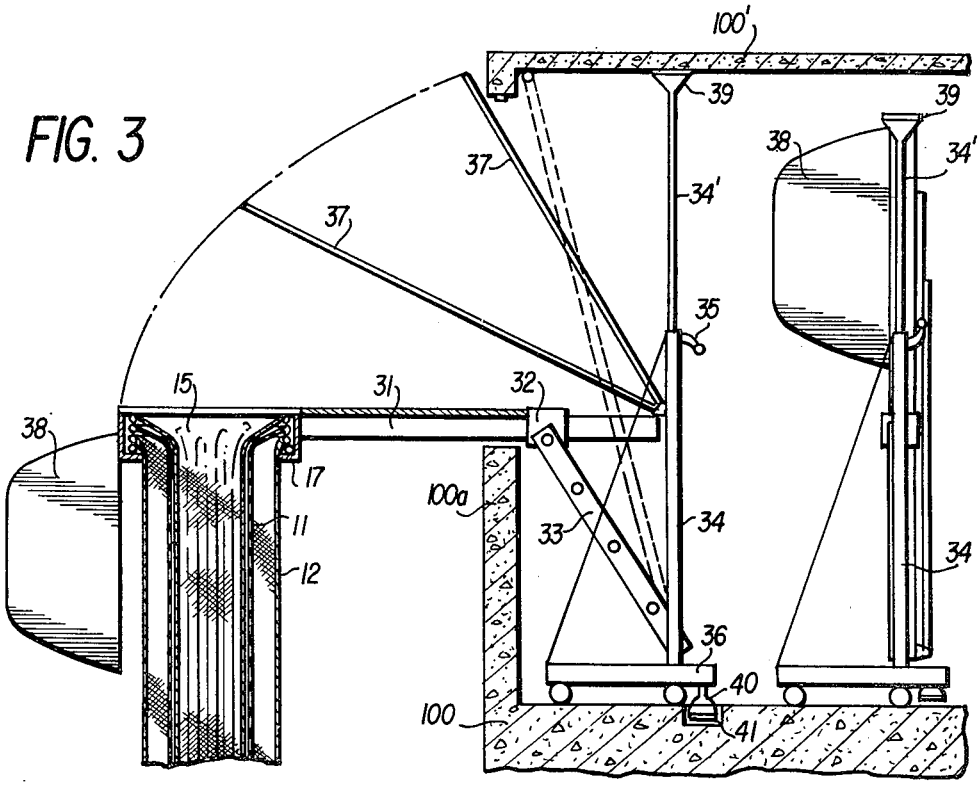

FIG. 7
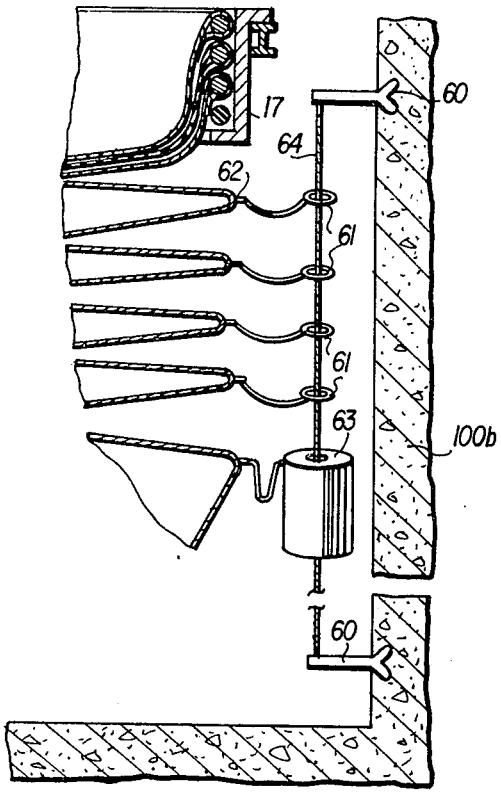
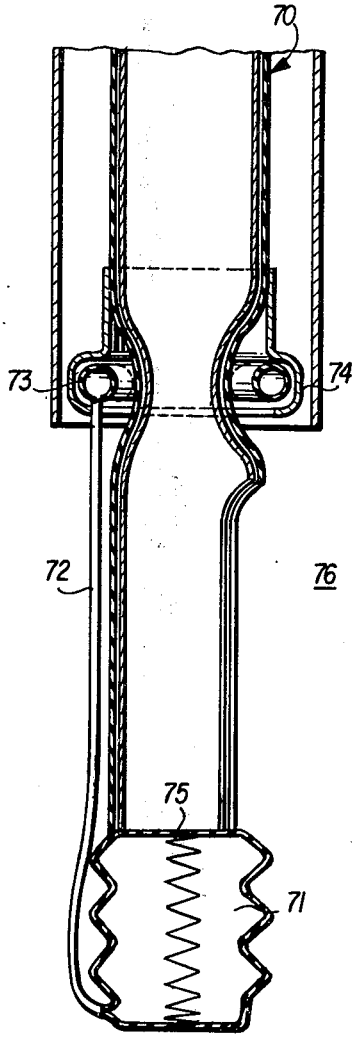
FIG. 8

FIG. 9
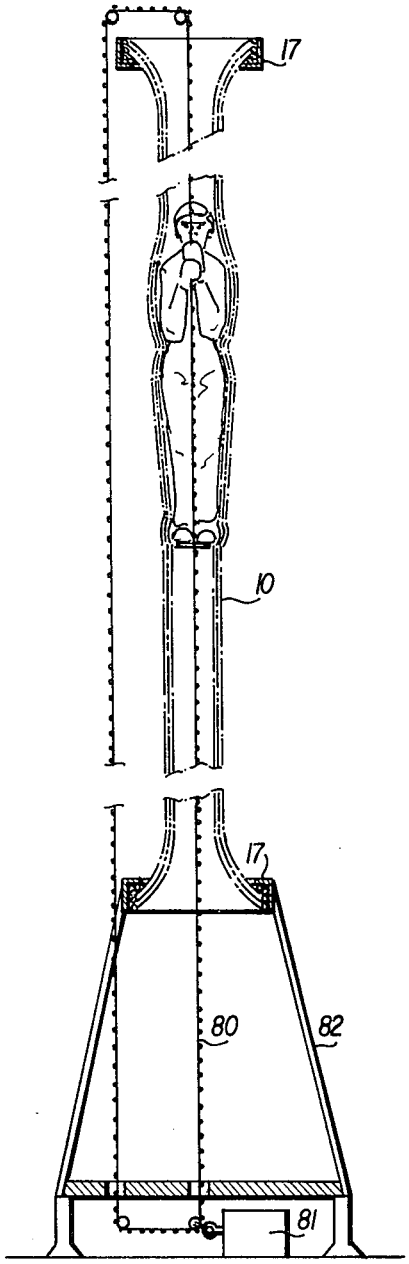
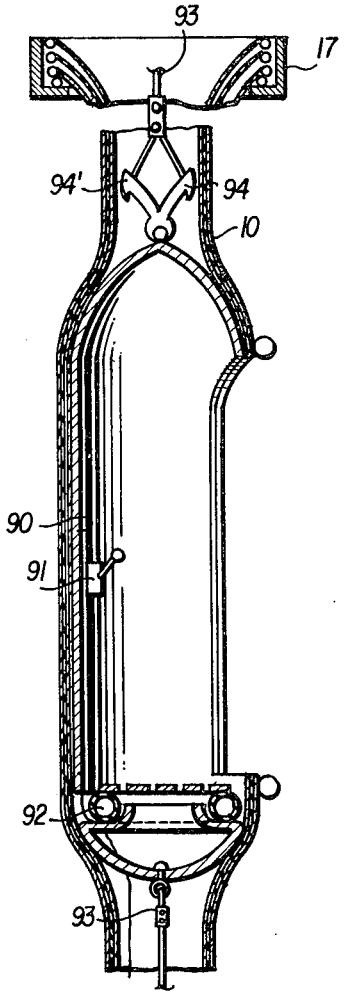
FIG. 10
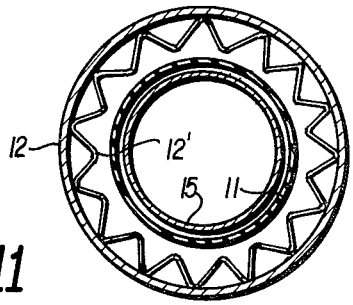
FIG. 11

RESCUE APPARATUS

This is a division of application Ser. No. 477,071, filed June 6, 1974.

The present invention relates to improvements in an apparatus for slowing the rate of descent of a falling body being evacuated from an elevated point to a point therebelow, such apparatus being particularly useful for rescuing persons in danger at the elevated point or removing objects from this point to the ground.

Apparatus of this general type is described in my prior French Pat. No. 1,604,702 or corresponding British Pat. No. 1,269,401, disclosing a flexible tubular device having two open ends, the disclosure of these patents being incorporated herein by way of reference. One end is substantially at the level of the elevated point, whence persons or objects are to be evacuated, where it is affixed to a wall or the like, and the other end is substantially at the level of the point therebelow, the tubular device extending substantially vertically from the elevated point to the point therebelow and being elastic in the transverse and circumferential but substantially inextensible in the longitudinal direction thereof. In my prior patent, this tubular device is a flexible tube which is elastic or yielding in its transverse and circumferential directions so that the same will be enlarged radially by a body falling downwardly through the tube by gravity while being inelastic, unyielding or inextensible in the longitudinal or axial direction thereof, thus restraining the body in the tube against free fall throughout its descent. This result is attained because the diameter of the flexible tube, before it is elastically extended by a body therein, is smaller than the diameter of this body. Thus, when the body enters inside the tube through the upper open end, elastic pressure is exerted upon the falling body radially inwardly, causing friction between the surface of the falling body and the tube which is not sufficient to burn the body but causes the rate of descent to be controlled, i.e. slowed. In the fall of a living and conscious body, the rate of descent may be readily controlled, even to a stop, by changing the diameter of the body to control the radial elastic pressure correspondingly, such change being effected simply by folding or extending the arms, for example, or bending the legs at the knees, or merely changing the position of the body.

It is one primary object of this invention to provide various improvements in the nature of the tubular device and/or the means for fixing the tubular device or its ends in position.

According to one embodiment of the invention, the tubular device comprises a first flexible tube having two open ends, one end substantially at the level of the elevated point and the other end substantially at the level of the point therebelow, the tube extending substantially vertically from the elevated point to the point therebelow and being elastic in the transverse and circumferential direction thereof, a second flexible tube having two open ends, one end substantially at the level of the elevated point and the other end substantially at the level of the point therebelow, the second tube extending coaxially within, and being surrounded by, the first tube, the second tube being substantially inextensible in the longitudinal direction thereof and having a perimeter in a transverse plane which is at least equal to the maximum perimeter of the first tube in this plane, and means for affixing the open ends of the tubes at the elevated point to receive a body for controlled descent to the open ends at the point therebelow through the coaxial tubes.

The inextensible second flexible tube has the following advantages:

a. It absorbs the vertical traction due to the deceleration by friction of the vertically falling body. This vertical traction could produce a 10 to 40 percent elongation of the elastic speed regulating tube if the inextensible lining were not provided.

b. It imparts superior safety to the apparatus in use and has economic advantages. For instance, if the second flexible tube is constituted by a woven fabric comprising warp threads extending substantially parallel to the longitudinal or axial direction of the tube and having considerable resistance to elongation, i. e. practically no extensibility, this tube alone will support a falling body in the tube in case of a blockage along the path of descent. Thus, the first tube need not have any substantial resistance to traction in the vertical direction, its sole function being to apply an elastic radial pressure against the falling body. This considerably reduces the cost of the material for the first tube.

The above and other objects, advantages and features of the present invention will become more apparent from the following detailed description of certain new preferred embodiments thereof, taken in conjunction with the accompanying drawing wherein FIG. 1 is a side elevational view, in transverse axial section, of the upper end of one embodiment of the apparatus of this invention;

FIG. 2 is a sectional view showing a modification of one part of the embodiment of FIG. 1;

FIG. 3 is a side elevational view, partly in transverse section, of one embodiment of affixing the upper end of the apparatus at the elevated point;

FIG. 7 is a partial side elevational view, partly in section, of still another embodiment of the apparatus;

FIG. 8 is a side elevational view, partly in section, of one embodiment of the lower end of the apparatus;

FIG. 9 is a side elevational view, in transverse section, of yet another embodiment of the apparatus;

FIG. 10 is a view similar to that of FIG. 9 of a further embodiment of the apparatus; and FIG. 11 is a transverse section of yet another embodiment of the apparatus.

Figure 4:
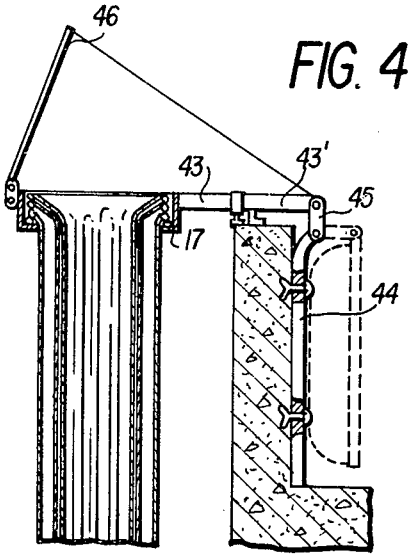
FIG. 4 is a view similar to that of FIG. 3 and showing another embodiment of the means affixing the upper end of the apparatus at the elevated point.

Referring now to the drawing and first to FIG. 1, the tubular rescue device for decelerating the rate of descent of bodies falling therethrough is shown to be comprised of first tube 11 which is flexible and elastic in the transverse and circumferential direction thereof, i. e. radially yielding. According to one feature of the present invention, a second flexible tube 15 extends coaxially within, and is surrounded by, first tube 11, thus lining the elastic tube. Second tube 15 is substantially inextensible in the longitudinal or axial direction thereof, i. e. it does not substantially yield in this direction, and has a diameter at least equal to the maximum perimeter of the first tube in a transverse plane.

In accordance with one object of the invention, the transverse modulus of elasticity of the flexible tube 11 is lower than 30 kg/cm2 under normal conditions of use, i. e. for specific loads lower than 5 kg/cm2. This arrangement makes it possible to obtain a braking tube with performances as good for bodies or objects weighing 100 kg as for bodies or objects of 10 kg.

This tubular rescue device consisting of a radially yielding outer tube lined by an axially non-yielding inner tube has two open ends respectively at the level of the elevated point, where a person or object to be evacuated may enter, and at the level of the point therebelow, where the person or object leaves the device, the tubular device extending substantially vertically from the elevated point to the point therebelow to permit the person or object to descend by gravity through the tubular device from the elevated point to the point therebelow. FIG. 1 shows only the upper open end of the tubular device and the means for affixing the open ends of tubes 11 and 15 at the elevated point where it receives a body for controlled descent to the open ends at the point therebelow through the coaxial tubes (not shown in FIG. 1).

Inner, non-elastic tube 15 is made by textile manufacturing methods tending to impart to the tube very great resistance to traction, particularly in the longitudinal or axial direction of the tube. Therefore, according to one preferred feature of this invention, tube 15 is constituted by a woven fabric comprising warp threads, which extend substantially parallel to the longitudinal direction, composed of a material having excellent mechanical properties, with high resistance to fire, abrasion, chemical and/or atmospheric corrosion, and very low elongation or extensibility. Preferably, the warp threads are composed of continuous filaments and the most preferred material therefor are acrylic or polyamide synthetic resins, or glass.

One most useful woven fabric for tube 15 comprises weft threads composed of continuous filaments of an acrylic or polyamide synthetic resin and warp threads composed of continuous glass filaments, the synthetic resin weft threads covering the glass warp threads over a larger surface interiorly of tube 15 than exteriorly thereof.

While the manufacture of tube 15 is not so limited, the following examples highlight some useful ways of making such a tube.

a. The warp threads are comprised of strands of twisted continuous glass filaments of the textile type, the strands being impregnated with suitable synthetic resins to make them abrasion resistant and less pliable.

The weft threads of the acrylic filament type which presently are most attractive from the point of view of price in relation to their high resistance to abrasion, heat and aging.

The warp and weft threads are so woven that the glass warp threads are well protected on the inside of the tube by the acrylic weft threads, i. e. the acrylic threads cover a large area of the glass threads interiorly of the tube.

b. The warp threads and the weft threads are comprised of acrylic filaments.

c. The warp threads are comprised of polyamide filaments while the weft threads are comprised of acrylic filaments.

Since the perimeter of inner tube 15 in a transverse plane is at least equal to the maximum, i. e. radially expanded, perimeter of the elastic tube 11 in this plane, longitudinally inextensible tube 15 will either be naturally rumpled in the rest position of the tubular device, when elastic tube 11 is not radially expanded, or, as shown in FIG. 1, tube 15 may be longitudinally pleated, a plurality of pleats **15*b* extending about the entire periphery of tube 15, these pleats being of small dimension with respect to the perimeter of the tube 15. In this manner, tube 15 will be able to expand radially with elastic tube 11 when subjected to outward radial pressure by a body in the tube, which has a diameter exceeding that of the tube at rest, the elasticity of outer tube 11 pressing the tubes radially inwardly against the body as it descends by gravity through the tubular device and inner tube 15** resisting traction in the longitudinal direction due to its inextensibility in this direction.

The inner tube 15 advantageously has, on its outer face, a coefficient of friction lower than that of its inner face. This disposition of the invention makes it possible to facilitate the unpleating of the tube 15 under the action of the falling bodies and thus to avoid these bodies getting stuck due to the presence of large pleats in said tube 15.

The means for affixing the open ends of the tubes at the elevated point is illustrated in FIG. 1 to include rigid and cylindrical support sleeve 17 affixed to the elevated point, for instance a building wall or the like, by a bracket including support beams 18. The support sleeve has annular, inwardly directed shoulder **17*a*. A substantially rigid annular part constitutes the upper open end of the tubular device and this rigid annular part is supported on support sleeve shoulder 17*a*** with some lateral play.

As shown in FIG. 1, the rigid annular part consists of rigid open ends of both tubes, the two open ends being of substantially the same diameter forming an outwardly flaring, funnels-shaped entrance for a person or object into the tubular device. The rigid open end of elastic outer tube 11 is supported on the support sleeve shoulder and the rigid open end of inner tube 15 is supported on the rigid open end of tube 11.

Each rigid annular end of the tubes is constituted in the illustrated embodiment by rigid ring 14, 14′ mounted within an annular channel formed by folded-over edge portion **15*a*, 11*a* which has a free edge affixed to the outer wall of the tube. The free edges of the folded-over edge portions may be sewn to the tube wall or bonded thereto, or sewn and bonded, to hold the ring in position. Rings 14, 14′ may be tubular. It may be desirable to reinforce or double up the free edge of edge portion 15*a* to assure the firm positioning of ring 14. The rings 14′ 14 are advantageously split in order to facilitate their assembly on tubes 11 and 15**.

In the embodiments shown in FIG. 1, the tubular rescue device consisting of tubes 11 and 15 is protected by surrounding heat resistant tube 12 having an upper open end supported in sleeve 17 in the identical manner as tubes 11 and 15, i. e. the open end of thermal protective tube 12 is made rigid by ring 14′, being of the same diameter at the rigid open ends of tubes 11 and 15, the end of tube 11 resting on that of tube 12, i. e. the rigid perimeters of the open ends of the three tubes being superposed within sleeve 17 and a shock-absorbing elastic ring 16 being interposed between shoulder **17*a* and the rigid superposed perimeters of the tube ends, ring 16** resting directly on the shoulder.

The described and illustrated manner of affixing the open upper end of the tubular rescue device is quite simple while affording great safety in holding the device in place.

The thermal protective tube is made of a material affording maximum protection against heat and fire, such as glass textile materials which may be coated with aluminum, asbestos, or the like.

This tube 12 is advantageously permanently impregnated with water, for example by means of a perforated flexible pipe (not shown), which is connected to a source of pressurised water and which is fixed, for example longitudinally or helically, to said thermal protective tube 12.

FIG. 11 shows an improved meat and fire protection for the tubular rescue or escape device. In this modification, longitudinally pleated tube 12' is arranged to extend coaxially between protective tube 12 and elastic tube 11 of the tubular device so as to increase the column of air between the tubular device and outer protective tube 12.

FIG. 2 shows a modification for fixing the upper open ends of the coaxial tubes for very long tubular rescue devices. In this case, support sleeve 17 for the upper tube ends is attached to the bracket arms or beams 18 by means of shock-absorbing spring means 19 which absorbs vibrations. This will alleviate the effects of sudden overloads on longitudinally inextensible inner tube 15, which may result, for example, from a sudden stoppage of a large number of persons or objects descending through the tubular device.

The inner tube is stable in both warp and weft directions and is designed to absorb the vertical force exerted by the friction caused by the descending body and to bear the whole weight of the body in the even of a stoppage. The elastic tube is designed to regulate the speed of the descending body by stretching radially. The external heat resistant tube may be made of polyamide fibers able to withstand temperatures of 300° to 400°C and glass fibers which can withstand up to 800°C.

FIGS. 3 and 4 illustrate, by way of example only, two useful embodiments for affixing the open upper end of a tubular rescue or escape device to a building comprising a wall and a ballustrade at an elevated point whence a person or object is to be evacuated to a point therebelow.

FIG. 3 illustrates a mobile version which may be set up in different places, depending upon the location of the fire or other disaster requiring evacuation. FIG. 4 shows a fixed version which is economical for low rise buildings and also suitable for lifts, cable cars and ships, for example.

Referring to FIG. 3, the elevated point at which the open upper end of the tubular device of FIG. 1 is affixed comprises building walls 100 and 100' and ballustrade 100*a*. This upper end of the tubular device is attached to a free front end of bracket 31 which has a trap door extending over the open end and comprises the support beams 18 holding support sleeve 17 in position. A portion of bracket 31 intermediate the ends thereof is supported on the upper edge of ballustrade 100*a* which projects upwardly from wall 100 and is integral therewith. The rear end of bracket 31 is affixed to building wall 100 by means of telescoping fixing rod 34, 34' arranged to be buttressed between opposed walls 100 and 100' of the building, the fixing rod being connected to the rear end of the bracket by two connecting struts which form stairway 33. As shown, the entire structure is mobile, the rod and struts with the connected bracket being mounted on a wheeled bogie.

Alternatively, the bracket 31, 43, 43' may abut on an element forming part of the device for fixing said bracket so as to constitute with this fixing device an isostatic system fixed to walls 100, 100'.

The dimensions of the entire apparatus including the tubular device and its mean of mounting its upper end at an elevated point whence persons or objects are to be rescued or evacuated depends, of course, on the location where it is to be mounted. Bracket 31 comprises at least two arms or support beams for supporting sleeve 17, and these are made preferably of duraluminum or reinforced rigid plastic to obtain an optimum weight to strength ratio.

The mobile bogie illustrated in FIG. 3 comprises a wheeled support platform 36 on which telescoping fixing rod 34, 34' is mounted, like telescoping rod 32 being spaced from rod 34, 34' and one of the struts 33 of the stairway being pivoted at its respective ends to the telescoping rods. A like pair of telescoping rods are mounted on platform 36 at the other side thereof to support the other strut 33 of the stairway, this stairway leading from floor wall 100 up to bracket 31 to facilitate entry of a person into the open end of the tubular device. Struts 33 have a plurality of bores spaced along their lengths to serve as adjustable connecting points for the struts to rod 32 by means of bolts-and-nuts or like removable fastening elements. In this manner, the height of the bracket in respect of floor 100 may be readily and rapidly adjusted to conform to that of ballustrade 100*a*. However, the provision of rod 32 and stairway 33 is not absolutely necessary and the rear end of bracket 31 may also be connected directly to rod 34, 34' by means of a connecting piece glidably mounted on the rod and provided with means for blocking it in an adjusted position.

Telescoping rods which may be buttressed between a floor and ceiling wall are well known and comprise two telescoping rod portions 34, 34' glidably interconnected, with upper rod portion 34' being upwardly propelled by a spring or other propulsion system in the interior of lower rod portion 34. A latch of screw lock 35 is provided to block the telescoping rod portions in the desired position wherein the bogie may be moved (see right of FIG. 3), i. e. wherein the length of the rod is less than the distance between the floor and ceiling walls, 100'. When the lock is released (see left of FIG. 3), the propulsion system in the telescoping rod will propel rod portion 34' upwardly so that the flattened upper end 39 of the rod engages the ceiling and the rod is buttressed between the floor and the ceiling. In the buttressed position, the fixing rod need not be absolutely vertical, as illustrated.

The movable bogie may be anchored in position by cooperating anchoring elements 40, 41 mounted respectively on the bogie platform and floor wall 100 to increase the stability of the apparatus.

If desired and as shown in FIG. 3, light and mobile support rods 37 may be mounted on bracket 31 to support a cover or tent structure of non-inflammable and water-impermeable material so as to protect persons or objects entering the tubular device from the outside atmosphere, flames, water sprays, etc. If desired, such a protective cover may also consist of a rapidly inflatable tent.

As shown on the right in FIG. 3, where the mobile apparatus is illustrated when not in use, a container 38 is mounted on the bracket to contain the tubular device consisting of tubes 15, 11, 12 in zig-zag folded condition. Container 38 may consist of reinforced plastic or aluminum and is arranged to open automatically to permit the tubular device to fall out of it when the apparatus is moved into its position of use (shown at the left in FIG. 3), i. e. when bracket 31, which is stored upright on the bogie during non-use, is moved into a horizontal position wherein it is supported on ballustrade 100*a*.

To facilitate the rapid unfolding of the stored tubular device when it is removed from container 38, its lower end is weighted, for instance by ballast consisting of a roll filled with heavy granules or like material. In addition to the ballast, the lower end of the tubular device has one or more weighted cables attached thereto to enable the lower end to be anchored to the ground and thus to stabilize the tubular device in case of high winds, for instance.

The fixed apparatus of FIG. 4 is very simple and is devised for use primarily in low rise structures. In this case, the bracket whose outer end supports the open end of the tubular rescue device consists of two telescoping support beams 43, 43' for support of sleeve 17, the telescoping structure of the support beams permitting ready adjustment of the beam length to facilitate mounting and dismounting of sleeve 17. Links 44 connect the rear end of the bracket to anchoring frame 44, which is affixed to the ballustrade, and the linkage connection enables the bracket and the folded tubular device to be retracted into the interior of the building behind the ballustrade, as shown schematically in broken lines in FIG. 4. Again, support rods 46 may be linked to the bracket to support a cover or tent deployable to protect users of the tubular device in the manner described hereinabove.

Figure 5:
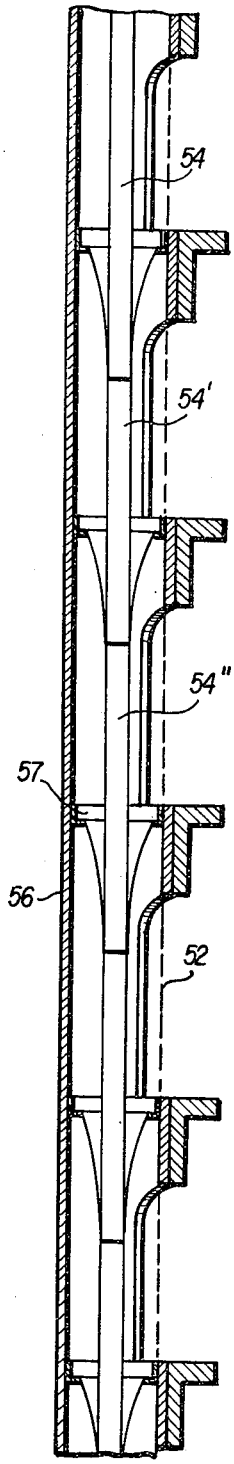
FIG. 5 is a side elevational view, partly in section, of another embodiment of the apparatus useful to receive bodies at superposed elevated points.

FIG. 5 illustrates an embodiment of the present rescue or escape apparatus wherein persons or objects may enter the tubular device at a plurality of elevated points spaced along the length of the device. In this apparatus, a plurality of like tubular devices are coaxially aligned, with the lower open ends of each superposed device 54, 54', 54'', etc., simply entering into the upper open ends of the next lower device. The upper open ends of the superposed tubular devices are affixed to the building at each elevated point at which it is desired to enable persons or objects to be evacuated, such mounting at each elevated point taking any suitable form, such as shown, for instance, in FIGS. 3 and 4.

The lower open end of each tubular device extends into the upper open end of the next lower tubular device for a sufficient distance to hold the lower end securely in the upper end, i. e. to prevent ready disengagement of the two superposed tubular devices. A support sleeve 57 is mounted at the level of each elevated point to support the upper end of a respective tubular device. The successive tubular devices are housed in rigid portectived tubing 56 which is fixed to the wall of the building and has access openings 52 at each elevated point. The protective tubing may consist of steel, aluminum, reinforced plastic or other suitable fire-resistant material and may have an isothermic lining. This structure constitutes an evacuation tower permanently attached to a high rise structure for instant use in case of emergencies requiring evacuation of personnel and/or objects from a plurality of levels. Several such evacuation towers may be provided for each structure, of course, as may be needed. While the tower has been shown attached to an interior or exterior wall of the structure, it could stand free and be connected to the structure by passageways at each level.

The interior of the tubular device may be illuminated, for instance by a series of small light bulbs mounted in a translucent hose extending throughout the length of the device. Also, loudspeakers may be mounted exteriorly along the tubular device to enable inter-communication between firemen and/or security personnel stationed on the ground and/or in the building and persons being evacuated through the tubular device so as to advise them in the control of the descending speed. This speed may be readily changed by any person in the tubular device simply by extending or retracting limbs so as to vary the diameter and thus the radial pressure of the elastic tube of the device. Exterior signals may be automatically operated by the falling body to show its position in the tubular devices, i. e. its distance from the ground.

Figure 6:
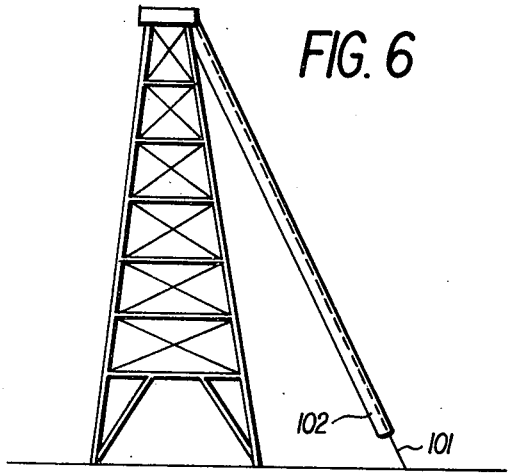
FIG. 6 is a schematic side elevational view of a derrick equipped with the apparatus of the invention.

FIG. 6 schematically illustrates the use of the tubular device of the invention on a tower or derrick. In this case, cable 101 extends through tubular device 102, thus enabling its lower open end to be spaced a desired distance from the base of the derrick where a fire may burn.

FIG. 7 illustrates the mounting of a tubular rescue device useful particularly in places where high winds prevail. In this embodiment, a longitudinal guiding element 64, such as a rail or the illustrated tensioned cable, is mounted on building wall 100*b* by means of anchors 60, 60', and a plurality of fastening elements 61 are connected to the tubular device at spaced points 62 thereof along the entire length thereof. The fastening elements are glidingly mounted on guiding element 64 by means of rings, the guiding element extending parallel to wall 100*b*. Ballast ring 63 is attached to the lower end of the tubular device to assure the unfolding of the device along the guiding element.

FIG. 8 illustrates a feature of the invention which facilitates the arrival of the evacuated person or object on the ground. For this purpose, shock-absorbing pneumatic bag 71 filled with a gaseous fluid, such as air, is disposed at the lower open end of tubular device 70 and open end 76 extends laterally of the device to permit the body received on cushion 71 to be evacuate from the device.

The illustrated cushioning means further comprises annular pneumatic chamber 73 surrounding tubular device 70 at a distance from the lower end and in communication with pneumatic bag 71. A body received on, and depressing, pneumatic bag 71 displaces the gaseous fluid from this bag into pneumatic chamber 73 to inflate the same, as shown in broken lines in FIG. 8. In this manner, the inflated pneumatic chamber constitutes an instant stop for any succeeding falling body in the tubular device as long as a body remains on bag 71. Thus, one person or object will not fall on top of another.

Outward expansion of pneumatic chamber 73 is limited by rigid sleeve 74 attached to the tubular device and defining an annular housing for chamber 73. In this manner, delivery of gaseous fluid from bag 71 to chamber 73 forces the same to expand only radially inwardly to constrict the tubular device and thus stop any body in the device from passing until the body resting on bag 71 has been removed, at which point compression spring 75 mounted in bag 71 forces the same back into its original position, causing gaseous fluid from chamber 73 to flow back into bag 71 under the radial pressure of a body pressing against the chamber 73.

FIG. 9 illustrates an embodiment wherein the tubular device is used as an elevator. In this embodiment, support sleeves 17 are provided for fixing the upper and the lower open ends of the tubular device 10 which is maintained under longitudinal tension between the two fixed ends. Elongated pretensioned element 80 extends through the tubular device from one end to the other. In the illustrated embodiment, the elongated device is an endless flexible ladder trained over four guide rollers mounted outside the tubular device and extrained by motor 81 so that a person may mount the ladder at the open upper end of the tubular device and be moved down by moving ladder 80. If desired, a simple cable may extend through the tubular device, the cable being provided with means to be grapped by a person for moving down therealong.

The support sleeve for the lower tubular device end is mounted on frame or housing 82 to facilitate access to the exit end of the device, frame 82 having the height of a man.

In the modification of FIG. 10, cabin 90 is attached to the pretensioned elongated element extending through tubular device 10 in a manner more fully illustrated and described in connection with FIG. 9. Cabin 90 is anchored to traction cable 93 and its descent is braked by the tubular device in case the cable breaks. The diameter of the cabin in relation to the radial elasticity of tubular device 10 is so determined that, in case of a cable rupture or failure of the elevator moving system, cabin 90 will only slowly descent even under a maximum load.

Cabin 90 has a cylindrical body, its conical roof being anchored to an upper portion of elevator cable 93 while its hemispherical bottom is attached to the lower portion of the cable. Anchors 94, 94' constitute a supplemental braking system when the tension of cable 93 diminishes noticeably. Furthermore, annular air chamber 92 disposed around the periphery of the cylindrical cabin body at its lower end may be inflated to provide additional braking power. The inflation of air chamber 92 may be proportional to the weight of the body or bodies supported by the floor of the cabin which rests on chamber 92. Alternatively or supplementally a capsule filled with a gaseous fluid (not shown) may be in communication with the air chamber, this communication being opened by control handle 91 in the cabin.

The apparatus of this invention constitutes a device for the simplest and most comfortable evacuation of people trapped in a building or any other high structure by fire or other disaster, such as an earthquake or explosion. It consists essentially of a textile tubular device so constructed as to stretch radially while remaining stable vertically. Any person, conscious or unconscious, entering the tubular device will descent slowly, irrespective of their weight, the rate of descent being controlleable by the position of the body.

The rescue system assures rapid evacuation while causing no dizziness to the evacuee and thus reduces panic. It may be produced in a mobile version and is not bulky, and may be rapidly erected, leaving other exits, such as stairs and elevators, free for recuers. It enables invalids, wounded and unconscious persons to be evacuated from any type of high or low rise building or tower, as well as from ships, oil drilling derricks or platforms, aircraft on the ground or hovering helicopters. It may be provided with access points at several levels and may be adapted for use as an elevator.

It will be clearly understood that various modifications and changes of the described embodiments may occur to those skilled in the art, particularly after benefitting from the present teaching, without departing from the spirit and scope of this invention as defined by the appended claims.

I claim:

1. An apparatus for slowing down the rate of descent of falling bodies being evacuated from a series of superposed elevated points along a building wall to a point therebelow, comprising a plurality of like flexible tubular devices coaxially aligned with each other and extending vertically along the building wall, each flexible tubular device having an upper open end and a lower open end, the upper end of each tubular device being substantially at the level of one of the elevated points and the lower end of a superposed one of the tubular devices extending into the upper end of the next lower one of the tubular devices for a sufficient distance to be held therein against outward displacement, an access opening in each tubular member adjacent its open end, the tubular devices being elastic in the transverse and circumferential but substantially inextensible in the longitudinal direction thereof.

2. The apparatus of claim 1, further comprising a rigid protective tubing surrounding the coaxially aligned flexible tubes and fixed to the building wall, the protective tubing defining access openings at the level of each elevated point.

3. An escape chute for lowering a person to the ground from elevated points comprising a series of flexible tubular members coaxially aligned extending substantially vertically between the elevated points and the ground, said flexible tubular members being elastic in the transverse and circumferential directions but substantially inextensible in the longitudinal direction thereof and having a cross-section whereby the descent of a person falling therethrough is maintained at a rate at which the person will not be injured when he reaches the ground, each of said tubular member having an outwardly flared open end supported at an elevated point and a lower open end, the lower open end of each of said tubular members above the lowermost tubular member having its lower end extending into the flared open end of the immediately lower tubular member to a point where it will remain therein while in use, and means for entering each tubular member adjacent to its supported upper open end.

* * * * *